US005772077A

United States Patent [19]

Tafur

[11] Patent Number: 5,772,077

[45] Date of Patent: Jun. 30, 1998

[54] HAIR STYLING IMPLEMENT AND VALVE ACTUATOR ATTACHMENT FOR AEROSOL AND PUMP DISPENSERS

[76] Inventor: Jose J. Tafur, 2122 Haven House, Spring, Tex. 77386

[21] Appl. No.: 646,437

[22] Filed: May 7, 1996

[51] Int. Cl.[6] ..... B67D 1/07

[52] U.S. Cl. ..... 222/192; 222/402 B; 119/611; 132/112

[58] Field of Search ..... 222/192, 402.1, 222/402.13; 132/112, 148; 119/603, 604, 611

[56] References Cited

U.S. PATENT DOCUMENTS

| | | | |
|---|---|---|---|
| 3,516,424 | 6/1970 | Eagle | 222/192 X |
| 3,636,963 | 1/1972 | Olson | 132/112 |
| 3,961,729 | 6/1976 | Grimm | 222/192 |
| 5,193,557 | 3/1993 | Hogan | 132/112 |

FOREIGN PATENT DOCUMENTS

| | | | |
|---|---|---|---|
| 2228165 | 6/1972 | Germany | 222/402.13 |

*Primary Examiner*—Joseph Kaufman

*Attorney, Agent, or Firm*—Kenneth A. Roddy

[57] ABSTRACT

A combination hair styling implement and valve actuator attachment for cylindrical aerosol and pump dispenser containers of the type having a dispensing valve in an upper end thereof. The elongate hair styling implement has a rear portion which when depressed opens the dispensing valve and expels fluid in a direction perpendicular to the longitudinal axis of the container in a generally conical-shaped spray pattern. The rear portion may contain a spray nozzle and have a central bore for attaching it to an existing discharge tube projecting from the top end of the container or may be configured to fit onto an existing spray nozzle plunger cap at the top end of a discharge tube. The device has a flat portion extending forwardly a distance from the rear portion at an angle relative to an axis perpendicular to the longitudinal axis of the container and generally parallel to the outer periphery of the conical-shaped spray pattern. The flat portion terminates in a distal end configured to manipulate and arrange sections of hair. The aerosol or pump container is held in the hand of an operator while manipulating and arranging sections of hair and the hair styling implement rear portion is selectively depressed by a finger of the hand holding the aerosol or pump container to apply an amount of the contents to the hair.

18 Claims, 3 Drawing Sheets

HAIR STYLING IMPLEMENT AND VALVE ACTUATOR ATTACHMENT FOR AEROSOL AND PUMP DISPENSERS

BACKGROUND OF THE INVENTION

1. Field of the Invention

This invention relates generally to attachments for aerosol and pump dispenser containers that have a discharge valve at the top end of the container, and more particularly to a combination hair styling implement and valve actuator attachment for aerosol and pump dispenser containers which has a rear portion which when depressed opens the dispensing valve and expels fluid in a direction perpendicular to the longitudinal axis of the container in a generally conical-shaped spray pattern beneath the distal end of the hair styling implement.

2. Brief Description of the Prior Art

Professional hairdressers and stylists spend many hours applying hair spray and styling the hair of a client. A common technique for styling the hair is to run a comb or hair lifter outwardly from the scalp through a section of the hair and lift a layer of the hair away from the scalp with one hand while holding an aerosol or pump dispenser containing hair spray in the other hand and applying a small amount of hair spray underneath the lifted section of hair, and then putting down the hair spray container and picking up a blow dryer to dry the hair, and then repeating this process until the desired results are achieved.

This process is difficult and time consuming. It requires the use of both hands and the hand holding the comb or hair lifter and hair in the lifted position will often obscure or be in the way of the target area where the spray should be directed. Also, since the hairdresser or stylist must put down the spray container and reach for the blow dryer, the hair which was lifted may fall back down before the spray can be applied.

The hair spray alters the characteristics of the hair, and in most styling techniques, it is preferable to apply the hair spray immediately before or during the lifting, brushing, or combing operation, and in conjunction with the warm air of the blow dryer.

It would therefore be desirable to provide a combination hair styling implement and valve actuator attachment for aerosol and pump dispenser containers which fits onto the depressable discharge tube or plunger cap projecting from the top of the container and allows the hairdresser or stylist to both lift the hair and apply the spray with one hand, and allows the other hand to be used for operating the blow dryer.

There are several patents which disclose various attachments for aerosol and pump dispenser containers of the type having a depressable discharge tube or plunger cap projecting from the head of the container and which discharge the contents when depressed.

Hogan, U.S. Pat. Nos. 3,960,160 and 5,193,557 disclose a hair treatment appliance comprising an elongate cylindrical body having a hollow chamber with an opening through the side wall and having a comb secured to one end and a hair lifter secured to the opposite end wherein an entire miniature hair spray can is contained inside the hollow chamber and the effluent is discharged through the opening in the side wall. The hair spray is discharged perpendicular to the longitudinal axis of the comb and hair lifter.

Myers, U.S. Pat. No. 3,973,853 discloses an applicator for an aerosol can which has a hair brush including a head and a handle. The aerosol can is secured to the back of the hair brush head above the handle. A mechanical linkage carried by the hair brush has a pivotal lever disposed adjacent the brush handle for depressing the aerosol can push button. A flexible tube inserted into the push button nozzle runs between the bristles and is apertured to discharge the effluent between and along the bristles of the brush.

Obata et al, U.S. Pat. No. 4,533,273 discloses an applicator for a foam aerosol container which has a cap and a brush attached to the cap. The cap has an integrally molded peripheral wall which fits the head of the container and surrounds the nozzle, a nozzle pushing member, and a discharge tube which fits onto the nozzle and discharges a foam detergent cleaner between and along the bristles of the brush.

Drake, U.S. Pat. No. 4,636,102 discloses an applicator for a foam shaving cream aerosol container which has a cap and an integral shaving cream brush attached to the cap. The cap is assembled in two pieces and has a firm outer housing which provides a gripping surface and a flexible activator assembly which allows the cap to be snapped onto the aerosol can. The flexible activator assembly has an activator button rigidly connected to a nozzle which are connected by a hinge to the brush in a hinged parallelogram structure. The foam shaving cream is discharged into and along the bristles of the brush.

Concalves, U.S. Pat. No. 4,848,946 discloses a brush type applicator for an aerosol container which has a dispensing head and a brush removably attached to the dispensing head. The dispensing head has an integrally molded peripheral skirt which snap fits onto a bead on the container and a movable portion with a discharge duct which fits onto the nozzle and discharges a detergent cleaner into the bristles of the brush.

Kuranski et al, U.S. Pat. No. 5,000,199 discloses an applicator for a foam hair lotion aerosol container which has a tubular attachment which is conically shaped at its lower end and may have a disc member surrounded by a ring at the lower end and has a hair brush or bomb at the upper end. The tubular conical end of the tubular attachment is received on the discharge tube of the aerosol container. The foam lotion is discharged through the tubular attachment and between the bristles of the brush or comb.

Helmstetter, U.S. Pat. No. 5,070,819 discloses a pet comb which attaches to an aerosol container. The comb includes a semi-circular clamp member which is snapped over the body of the aerosol container and has an upwardly and outwardly extending comb arm tangential to the semi-circular clamp terminating in a plurality of blunt teeth. When moved over the pet's coat, the teeth lift the hair to expose the pet's skin for receiving the sprayed flea or tick spray from the aerosol container. This device does not fit onto the nozzle of the container and the effluent is discharged by pressing down on the existing nozzle.

The above mentioned attachments which dispense a foam solution between and along the bristles of a brush or comb are not suitable for use with an aerosol hair spray because the brush bristles or comb tines will deflect the spray, and the aerosol hair spray will cause matting and sticking together of the bristles and will build up a sticky coating on the tines of a brush.

The present invention is distinguished over the prior art in general, and these patents in particular by a combination hair styling implement and valve actuator attachment for aerosol and pump dispenser containers that has a rear portion which when depressed opens the dispensing valve of the aerosol or pump dispenser and expels fluid in a direction perpendicular to the longitudinal axis of the container in a generally conical-shaped spray pattern. The rear portion of the attachment may contain a spray nozzle and have a central bore for attaching it to an existing discharge tube projecting from the top end of the container or may be configured to fit onto an existing spray nozzle plunger cap at the top end of a discharge tube. The device has a flat portion extending forwardly a distance from the rear portion at an angle relative to an axis perpendicular to the longitudinal axis of the container and generally parallel to the outer periphery of the conical-shaped spray pattern. The flat portion terminates in a distal end configured to manipulate and arrange sections of hair. The aerosol or pump container is held in the hand of an operator while manipulating and arranging sections of hair and the hair styling implement rear portion is selectively depressed by a finger of the hand holding the aerosol or pump container to apply an amount of the contents to the hair.

SUMMARY OF THE INVENTION

It is therefore an object of the present invention to provide a combination hair styling implement and valve actuator attachment for aerosol and pump dispenser containers which fits onto the depressable discharge tube or plunger cap projecting from the top of the container and allows the hairdresser or stylist to both manipulate and arrange the hair and apply hair spray with one hand, and allows the other hand to be used for operating a blow dryer or performing other operations.

It is another object of this invention to provide a combination hair styling implement and valve actuator attachment for aerosol and pump dispenser containers which is easily and quickly installed onto the depressable discharge tube or plunger cap projecting from the top of the container.

Another object of this invention is to provide a combination hair styling implement and valve actuator attachment for aerosol and pump dispenser containers which fits onto the top of the container and has an outer end configured to manipulate and arrange the hair.

Another object of this invention is to provide a combination hair styling implement and valve actuator attachment for aerosol and pump dispenser containers which fits onto the top of the container and has an outer end disposed in an angular plane above the outer periphery of the conical spray pattern to prevent the discharged effluent from being deflected and substantially prevent the effluent from forming a sticky coating on the hair styling implement.

A further object of this invention is to provide a combination hair styling implement and valve actuator attachment for aerosol and pump dispenser containers which fits onto the top of the container and has an outer end disposed in an angular plane to allow an unobstructed view of the area to which the hair spray is to be applied.

A still further object of this invention is to provide a combination hair styling implement and valve actuator attachment for aerosol and pump dispenser containers which is simple in construction and inexpensive to manufacture.

Other objects of the invention will become apparent from time to time throughout the specification and claims as hereinafter related.

The above noted objects and other objects of the invention are accomplished by a combination hair styling implement and valve actuator attachment for aerosol and pump dispenser containers that has a rear portion which when depressed opens the dispensing valve of the aerosol or pump dispenser and expels fluid in a direction perpendicular to the longitudinal axis of the container in a generally conical-shaped spray pattern. The rear portion of the attachment may contain a spray nozzle and have a central bore for attaching it to an existing discharge tube projecting from the top end of the container or may be configured to fit onto an existing spray nozzle plunger cap at the top end of a discharge tube. The device has a flat portion extending forwardly a distance from the rear portion at an angle relative to an axis perpendicular to the longitudinal axis of the container and generally parallel to the outer periphery of the conical-shaped spray pattern. The flat portion terminates in a distal end configured to manipulate and arrange sections of hair. The aerosol or pump container is held in the hand of an operator while manipulating and arranging sections of hair and the hair styling implement rear portion is selectively depressed by a finger of the hand holding the aerosol or pump container to apply an amount of the contents to the hair.

DESCRIPTION OF THE PREFERRED EMBODIMENTS

Figure 2:
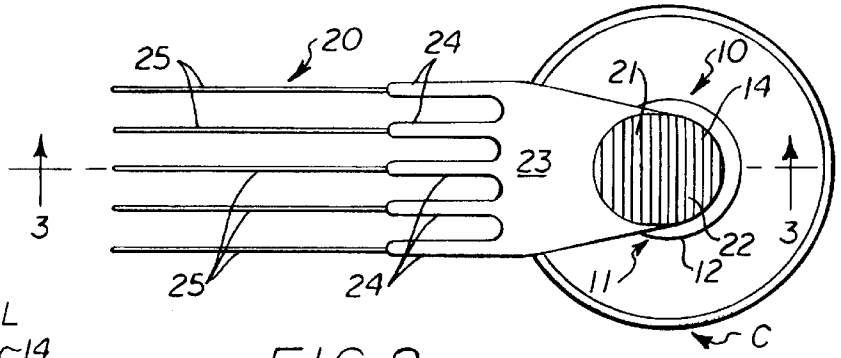
FIG. 2 is a top plan view of the embodiment of FIG. 1.
Figure 3:
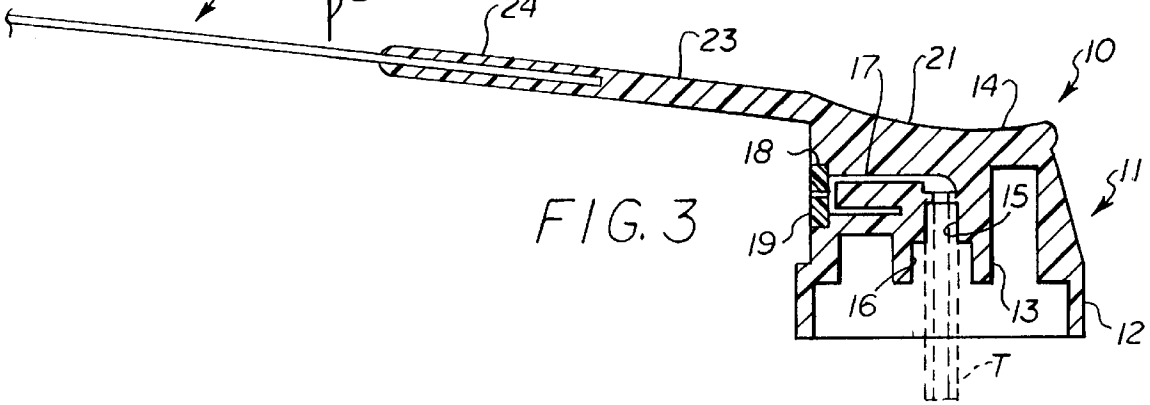
FIG. 3 is an enlarged cross section through the embodiment of FIG. 1, taken along the line 3—3 of FIG. 2.
Figure 1:
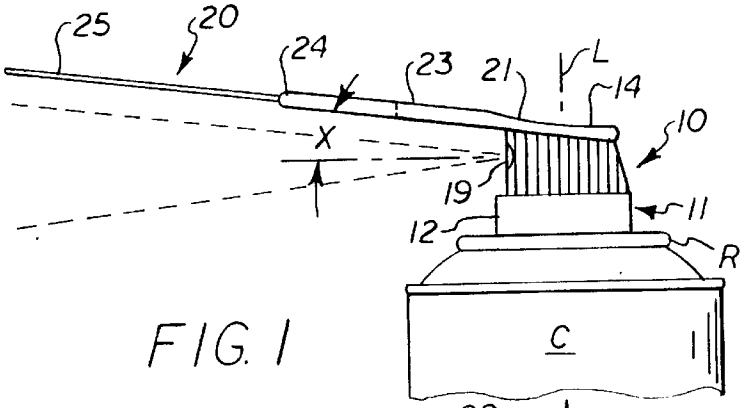
FIG. 1 is a side elevation of an embodiment of the combination hair styling implement and valve actuator attachment for aerosol and pump dispenser containers in accordance with the present invention which has a rear portion adapted to fit onto the discharge tube projecting from the top end of the container.

Referring to the drawings by numerals of reference, there is shown in FIGS. 1, 2, and 3, a combination hair styling implement and valve actuator attachment 10 for aerosol and pump dispenser containers in accordance with a preferred embodiment of the present invention which has a rear portion adapted to fit onto the discharge tube projecting from the top end of the container.

The attachment 10 is formed of a suitable plastic material and adapted to be removably installed on a conventional aerosol or pump dispenser container C of the type having a tubular discharge tube T projecting from the head of the container which receives a conventional spray nozzle plunger cap (not shown) and discharges the contents of the container through the spray nozzle of the plunger cap when it is pressed downwardly. In the embodiment of FIGS. 1–3, the conventional plunger cap is removed when installing the attachment 10, as explained below.

The attachment 10 is an integrally formed member having a dispensing portion 11 at a proximal end and a hair styling implement portion 20 at a distal end. The dispensing portion 11 has a circular outer wall 12, the lower end of which fits into the upper collar or rounded rim R at the top end of the aerosol or pump dispenser container C, a coaxial tubular extension 13 spaced radially inward from the outer wall 12, and an angular top wall 14. The tubular extension 13 has a central bore 15 extending inwardly from its bottom end and terminating just below the top wall 14, and may be provided with a counterbore 16 at its bottom end. The diameter of the central bore 15 is dimensioned to be slidably and frictionally engaged on the upstanding discharge tube T of the aerosol or pump dispenser container C. The counterbore 16 allows the tubular extension 13 to fit larger diameter discharge tubes. It should be understood that the central bore 15 may be tapered rather than counterbored to allow the tubular extension to fit discharge tubes of various diameters.

A discharge channel 17 extends laterally outward from the upper end of the bore 15 to the exterior of the outer wall 12. The discharge channel 17 is provided with a counterbore 18 at its outer end into which a nozzle or jet element 19 having a reduced diameter spray orifice is pressed fitted. The discharge channel 17 and counterbore 18 are sized and shaped in the fashion of the interior of a conventional spray nozzle plunger cap and the nozzle or jet element 19 is a conventional nozzle or jet element of the type used in a conventional spray nozzle plunger cap.

As best seen from the top in FIG. 2, the exterior of the top wall 12 has a concave depressed area 21 which receives the finger of the user and may be provided with transversely extending raised ridges 22 which provide a textured surface to aid in preventing the finger from slipping off the top surface. The hair styling implement portion 20 has a flat portion 23 which extends forward and diverges angularly outwardly (as seen from the top) from the dispensing portion 11 and its forward end is formed into a plurality of parallel laterally spaced ferrules 24. In the preferred embodiment, the hair styling implement portion 20 is in the form of what is known in the trade as a "pick" or "hair lifter" and has a plurality of elongate metal or plastic rods 25 (preferably metal) which extend outwardly from the ferrules 24. Alternatively, the outer end of the hair styling implement portion may be in the form of a comb wherein the plurality of parallel laterally spaced rods would be replaced by elongate parallel laterally spaced tines.

As seen from the side in FIGS. 1 and 3, the flat portion 23, ferrules 24, and rods 25 (or tines) of the hair styling implement portion 20 are in the same plane and extend forward and angularly upward at an angle "X" relative to a horizontal plane.

When the attachment 10 is pressed downwardly parallel to the longitudinal axis L of the container C, the discharge tube T is depressed which opens a dispensing valve inside the container C and the effluent is discharged by pressurized gas or a propellant through the discharge tube T, through the central bore 15, through the channel 17, and through the reduced orifice of the jet element 19. The effluent after passing through the orifice of the jet element 19 takes on a conical spray pattern which increases in diameter as its distance from the outer wall 12 increases.

The angle "X" of the flat portion 23, ferrules 24, and rods 25 (or tines) of the hair styling implement portion 20 is of sufficient magnitude to place these elements in a plane which is above and approximately parallel to the outer periphery of the conical spray pattern to prevent the discharged effluent from contacting and being deflected by these elements and to substantially prevent the effluent from forming a sticky coating on them.

When working on the hair, the hairdresser or stylist grips the aerosol or pump dispenser container with one hand and can easily run the hair styling implement portion 20 at the distal end through the hair and lift a layer of the hair and simultaneously apply a small amount of hair spray underneath the lifted section of hair as needed using only one hand. The other hand may be used for directing a blow dryer onto the hair or for performing other operations, such combing, brushing, teasing, etc. The outwardly extending hair styling implement portion is always positioned in the direction that the spray will be discharged and also serves as a guide when spraying the hair.

Figure 5:
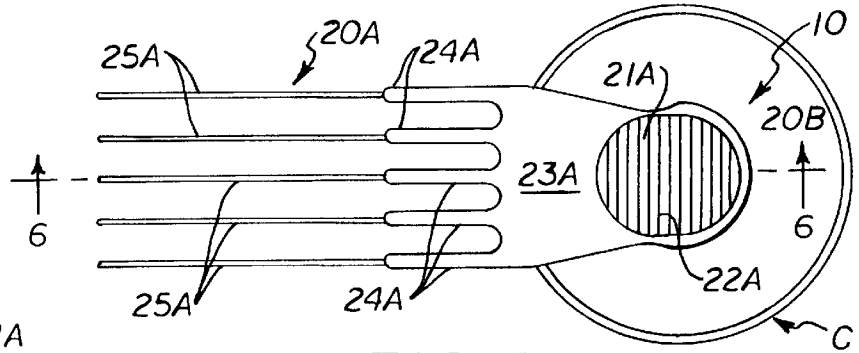
FIG. 5 is a top plan view of the embodiment of FIG. 4.
Figure 4:
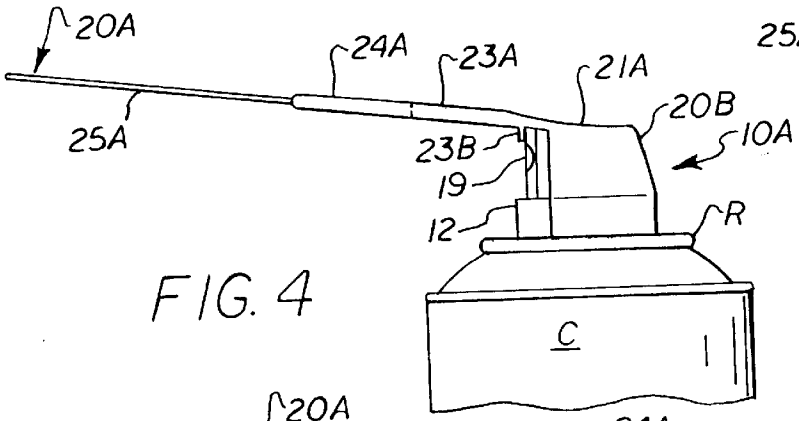
FIG. 4 is a side elevation of an embodiment of the combination hair styling implement and valve actuator attachment for aerosol and pump dispenser containers in accordance with the present invention which has a rear portion adapted to fit onto a spray nozzle plunger cap at the top end of the discharge tube of the container.
Figure 6:
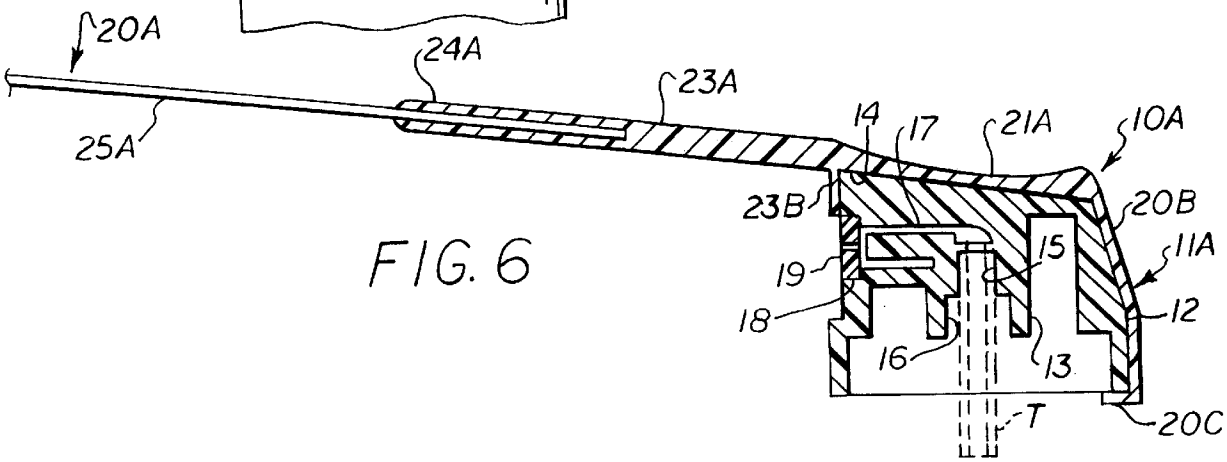
FIG. 6 is an enlarged cross section through the embodiment of FIG. 4, taken along the line 6—6 of FIG. 5.

To reduce molding costs, rather than having the whole attachment formed as one integral unit, the dispensing portion 11 may be molded separate from the hair styling implement portion 20, and then the separate members can be snap fitted together. Optionally, the separately molded hair styling implement portion 20 may be installed on existing spray nozzle plunger caps. FIGS. 4, 5, and 6, show an embodiment of the combination hair styling implement and valve actuator 10A for aerosol and pump containers wherein the dispensing portion is molded separate from the hair styling implement portion, and then the separate members are snap fitted together.

In this embodiment, the dispensing member 11A has a circular outer wall 12 the lower end of which fits into the upper collar or rounded rim R at the top end of the aerosol or pump dispenser container C, a coaxial tubular extension 13 spaced radially inward from the outer wall 12, and an angular top wall 14. The tubular extension 13 has a central bore 15 extending inwardly from its bottom end and terminating just below the top wall 14, and may be provided with a counterbore 16 at its bottom end. The diameter of the central bore is dimensioned to be slidably and frictionally engaged on the upstanding discharge tube T of the aerosol or pump container C. The counterbore 16 allows the tubular extension 13 to fit larger diameter discharge tubes. It should be understood that the central bore 15 may be tapered rather than counterbored to allow the tubular extension to fit discharge tubes of various diameters.

A discharge channel 17 extends laterally outward from the upper end of the bore 15 to the exterior of the outer wall 12. The discharge channel 17 is provided with a counterbore 18 at its outer end into which a jet element 19 having a reduced diameter spray orifice is pressed fitted. The discharge channel 17 and counterbore 18 are sized and shaped in the fashion of a conventional spray nozzle plunger cap and the nozzle or jet element 19 is a conventional nozzle or jet element of the type used in a conventional spray nozzle plunger cap.

In this embodiment, the hair styling implement member 20A has a has semi-circular skirt 20B at its rear end which extends downwardly and partially encircles the circular outer wall 12 of the dispensing member 11A and has a small lip 20C extending radially inward which is received beneath the bottom end of the outer wall 12 of the dispensing member 11A. A flat portion 23A extends forward and diverges angularly outwardly (as seen from the top) from the skirt 20B and its forward end is formed into a plurality of parallel laterally spaced ferrules 24A, which in the preferred embodiment, has a plurality of elongate metal or plastic rods 25A (preferably metal) which extend outwardly from the ferrules 24A. Alternatively, the outer end of the hair styling implement portion may be in the form of a comb wherein the plurality of parallel laterally spaced rods would be replaced by elongate parallel laterally spaced tines.

The flat portion 23A of the hair styling implement member 20A has a short lip 23B depending from its underside which is received on the exterior of the top end of the dispensing member 11A, and the underside of the flat portion is supported on the angular top wall of the dispensing member 11A.

The dispensing member 11A is snap fitted into the semi-circular skirt 20B and retained by the skirt and the lips 20C and 23B. The assembly is then installed on the existing tubular discharge tube T projecting upwardly from the aerosol or pump container, as described previously.

As described in the previous embodiment, the hair styling implement member 20A is provided with a concave depressed area 21A which receives the finger of the user and may be provided with transversely extending raised ridges 22A which provide a textured surface to aid in preventing the finger from slipping off the top surface. Also, as previously described, when the attachment 10A is pressed downwardly parallel to the longitudinal axis of the aerosol or pump container C, the discharge tube T is depressed which opens a dispensing valve inside the container C and the effluent is discharged by a pressurized gas or propellant through the discharge tube T, through the central bore 15, through the channel 17, and through the reduced orifice of the jet element 19. The effluent after passing through the orifice of the jet element 19 takes on a conical spray pattern which increases in diameter as its distance from the outer wall 12 increases.

As seen from the side in FIGS. 4 and 6, the flat portion 23A, ferrules 24A, and rods 25A (or tines) of the hair styling implement portion 20A are in the same plane and extend forward and angularly upward at an angle relative to a horizontal plane which is of sufficient magnitude to place these elements in a plane which is above and approximately parallel to the outer periphery of the conical spray pattern to prevent the discharged effluent from contacting and being deflected by these elements and to substantially prevent the effluent from forming a sticky coating on them, as described previously.

It should also be understood that with this embodiment, the hair styling implement member 20A may be used separately from the dispensing member 11A, by press fitting a conventional commercially available spray nozzle plunger cap of appropriate size into the semi-circular skirt 20B to be retained by the skirt and the lips 20C and 23B. If the conventional spray nozzle plunger cap has a flat top surface, the underside of the flat portion 23A becomes angularly positioned relative to the flat top surface when the lip 20C is engaged beneath the bottom end of the plunger cap.

In the previous examples, the dispensing portion 11 or 11A of the attachment is shown to be received on the discharge tube of the aerosol or pump container or to cover a spray nozzle plunger cap which is received on the discharge tube. However, many aerosol dispensers do not utilize a discharge tube. Instead, some aerosol dispensers utilize a spray nozzle plunger cap which has an integral discharge tube at its bottom end.

It should be understood that a conventional spray nozzle plunger cap having an integral discharge tube of appropriate size may be press fitted into the semi-circular skirt 20A to be retained by the skirt and the lips 20C and 23B.

Figure 7:
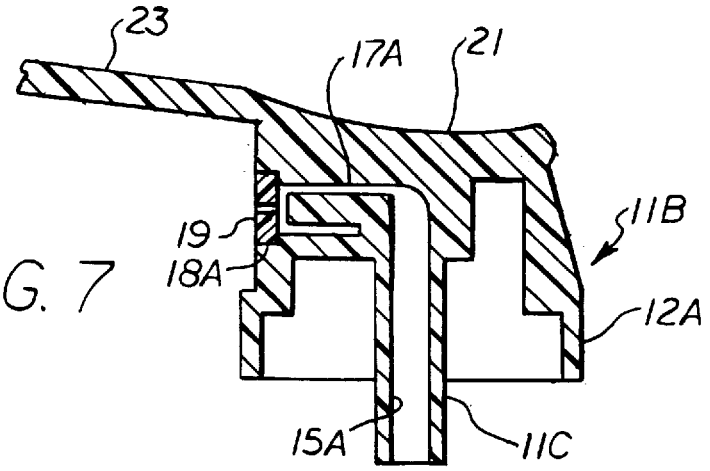
FIG. 7 is an enlarged cross section through a modification of the rear portion of the combination hair styling implement and valve actuator attachment, showing a discharge tube integrally formed on the rear portion.

FIG. 7 shows an enlarged cross section through a modification of the dispensing portion 11B of the integrally formed combination hair styling implement and valve actuator attachment of FIGS. 1–3 wherein the bottom end of the dispensing portion 11B is configured to actuate the dispensing valve of aerosol dispenser containers which do not utilize a separate discharge tube. The dispensing portion 11B has an integrally formed vertical tubular discharge tube 11C surrounded by a concentric radially spaced circular outer wall 12A, the lower end of which fits into the upper collar or rounded rim at the top end of the aerosol container. The discharge tube 11C extends a distance below the circular outer wall 12A and has a central bore 15A extending upwardly a distance from its bottom end. The diameter of the discharge tube 11C is dimensioned to be slidably and frictionally engaged in the existing port at the top end of the aerosol container and releasably engage the existing dispensing valve inside the container.

A discharge channel 17A extends laterally outward from the upper end of the bore 15A to the exterior of the outer wall 12A. The discharge channel 17A is provided with a counterbore 18A at its outer end into which a nozzle or jet element 19 having a reduced diameter spray orifice is pressed fitted. The discharge channel 17A and counterbore 18A are sized and shaped in the fashion of the interior of a conventional spray nozzle plunger cap and the nozzle or jet element 19 is a conventional nozzle or jet element of the type used in a conventional spray nozzle plunger cap.

Figure 9:
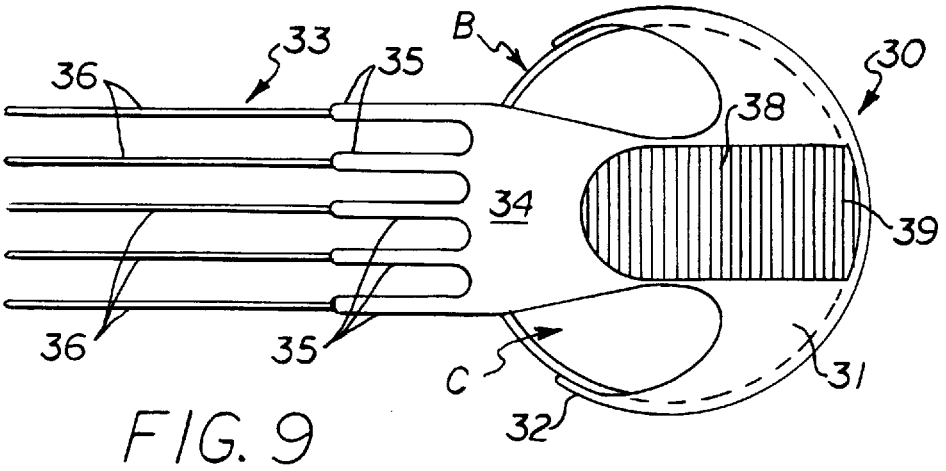
FIG. 9 is a top plan view of the embodiment of FIG. 8.
Figure 8:
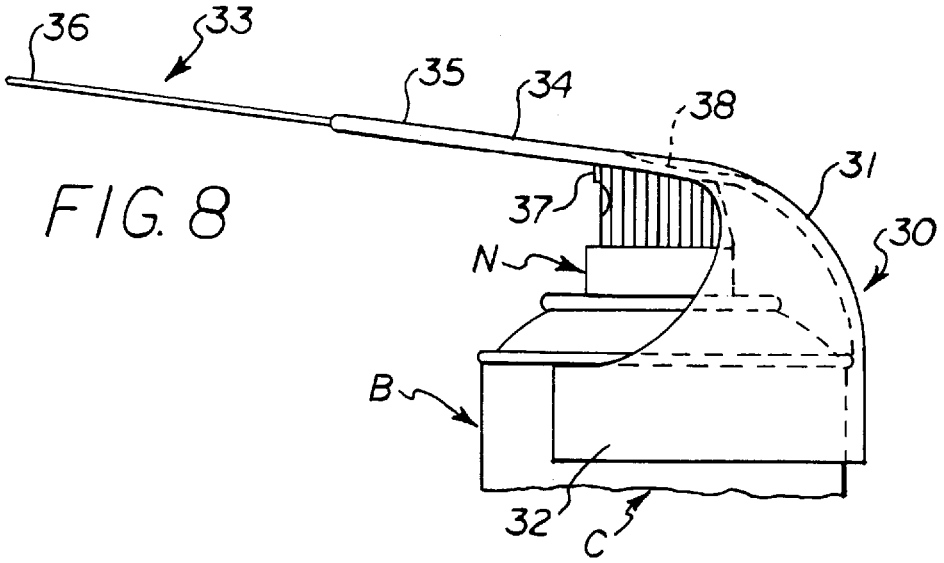
FIG. 8 is a side elevation of an embodiment of the combination hair styling implement and valve actuator attachment for aerosol and pump dispenser containers in accordance with the present invention which has a rear portion adapted to fit onto the exterior of the container and over the spray nozzle plunger cap at the top end of the discharge tube of the container.

FIGS. 8 and 9 show another modification 30 of the combination hair styling implement and valve actuator attachment for aerosol and pump containers wherein the rear portion of the attachment is releasably attached to the cylindrical body B of the aerosol or pump dispenser container C, and its upper portion is engaged on an existing spray nozzle plunger cap N.

In this embodiment, the rear end 31 of the attachment 30 is curved downwardly about a transverse horizontal axis and adjoins a semi-circular skirt 32 which is curved about a vertical axis. The semi-circular skirt 32 is dimensioned to partially encircle the cylindrical body B of the aerosol or pump container C, and is sufficiently resilient so as to snap fit thereon when laterally pressed against the cylindrical container body. The downwardly curved rear portion 31 is sufficiently thin so as to be resiliently flexible.

As seen from the top in FIG. 8, the attachment 30 has a hair styling implement portion 33 with a flat portion 34 which extends forwardly from the curved portion 31 and diverges angularly outwardly from the curved portion and its forward end is formed into a plurality of parallel laterally spaced ferrules 35, which in the preferred embodiment, has a plurality of elongate metal or plastic rods 36 (preferably metal) which extend outwardly from the ferrules 35. Alternatively, the outer end of the hair styling implement portion may be in the form of a comb wherein the plurality of parallel laterally spaced rods would be replaced by elongate parallel laterally spaced tines.

As seen from the side in FIG. 8, the flat portion 34, ferrules 35, and rods 36 (or tines) of the hair styling implement portion 33 are in the same plane and extend forward and angularly upward at an angle relative to a horizontal plane which is of sufficient magnitude to place these elements in a plane which is above and approximately parallel to the outer periphery of the conical spray pattern to prevent the discharged effluent from contacting and being deflected by these elements and to substantially prevent the effluent from forming a sticky coating on them, as previously described.

The flat portion 34 of the hair styling implement portion 33 has a short lip 37 depending from its underside which is received on the exterior of the top end of the existing aerosol or pump spray nozzle plunger cap N, and the underside of the flat portion is supported on the top wall of the existing plunger cap.

The semi-circular skirt portion 32 of the attachment 30 is snap fitted onto the cylindrical body B of the aerosol or pump container C and retained on the container by the resiliency of the skirt 32 and the depending lip 37 is engaged on the front of the spray nozzle plunger cap N to properly position the outwardly extending flat portion 34.

As described in the previous embodiments, the attachment 30 is provided with a concave depressed area 38 which receives the finger of the user and may be provided with transversely extending raised ridges 39 which provide a textured surface to aid in preventing the finger from slipping off the top surface.

When the concave area 38 of the attachment 30 is pressed downward, The flat portion 34 flexes downwardly and pushes the spray nozzle plunger cap N downwardly parallel to the longitudinal axis of the aerosol or pump container and the discharge tube T is depressed which opens a dispensing valve inside the container C and the effluent is discharged by a pressurized gas or propellant through the nozzle or jet of the spray nozzle plunger cap N.

While this invention has been described fully and completely with special emphasis upon a preferred embodiment, it should be understood that within the scope of the appended claims the invention may be practiced otherwise than as specifically described herein.

I claim:

1. A combination hair styling implement and valve actuator attachment for cylindrical aerosol and pump dispenser containers of the type having a dispensing valve in an upper end and a discharge tube projecting outwardly from a top end of the aerosol or pump container parallel to a longitudinal axis of the container, the attachment comprising:

an elongate hair styling implement having a rear portion with means for engaging and depressing said outwardly projecting discharge tube parallel to the longitudinal axis of said aerosol or pump container to open said dispensing valve and having spray nozzle means in fluid communication with said discharge tube for expelling fluid therethrough in a direction perpendicular to said longitudinal axis in a generally conical-shaped spray pattern;

a flat portion extending forwardly a distance from said rear portion at an angle relative to an axis perpendicular to said longitudinal axis and generally parallel to the outer periphery of said conical-shaped spray pattern; and said flat portion terminating in a distal end portion configured to manipulate and arrange sections of hair;

said aerosol or pump container being held in the hand of an operator while manipulating and arranging sections of hair and said hair styling implement rear portion selectively depressed by a finger of the hand holding said aerosol container to apply an amount of the contents of said container to the hair.

2. The combination hair styling implement and valve actuator attachment according to claim 1 wherein said distal end portion comprises a plurality of parallel laterally spaced projections extending a distance from said forwardly extending flat portion and in a plane transverse to said longitudinal axis.

3. The combination hair styling implement and valve actuator attachment according to claim 1 wherein said rear portion has a top surface with a concave depressed area to receive the finger of the operator.

4. The combination hair styling implement and valve actuator attachment according to claim 3 wherein said concave depressed area has a plurality of transversely extending raised ridges to provide a textured surface to aid in preventing the finger of the operator from slipping off said top surface.

5. The combination hair styling implement and valve actuator attachment according to claim 1 wherein said rear portion has a depending generally cylindrical portion terminating at a bottom end and a central bore extending vertically upward a distance from said bottom end, said central bore dimensioned to be received and removably engaged on the outwardly projecting portion of said discharge tube;

a discharge channel extending laterally outward from an upper end of said central bore to the exterior of said generally cylindrical portion in fluid communication with said discharge tube; and a spray nozzle element secured in said discharge channel and having an orifice therethrough configured to expel fluid therethrough in a generally conical-shaped spray pattern in a direction perpendicular to said longitudinal axis.

6. The combination hair styling implement and valve actuator attachment according to claim 1 wherein said rear portion has a depending semi-circular skirt defining a semi-circular cavity;

a cylindrical plunger element releasably engaged in said semi-circular cavity;

said cylindrical plunger element having a bottom end with a central bore extending vertically upward a distance from said plunger bottom end dimensioned to be received and removably engaged on the outwardly projecting portion of said discharge tube, a discharge channel extending laterally outward from an upper end of said central bore to the exterior of said plunger element in fluid communication with said discharge tube, and a spray nozzle element secured in said plunger discharge channel with an orifice therethrough configured to expel fluid therethrough in a generally conical-shaped spray pattern in a direction perpendicular to said longitudinal axis; and upon said pressing said hair styling implement downward, said plunger element contained in said semi-circular cavity moving with said hair styling implement and depressing said outwardly projecting discharge tube parallel to the longitudinal axis of said aerosol or pump container to open said dispensing valve.

7. The combination hair styling implement and valve actuator attachment according to claim 6 wherein said semi-circular cavity has a first lip on a bottom end extending radially inward a short distance; and said forwardly extending flat portion has a second lip depending a short distance from an underside thereof;

said first and second lips sized to snap fit and releasably engage exterior surfaces of said cylindrical plunger element.

8. The combination hair styling implement and valve actuator attachment according to claim 1 wherein said discharge tube has a generally cylindrical plunger element with a central vertical bore engaged on its outwardly projecting portion, a discharge channel extending laterally outward from an upper end of said central bore to the exterior of said plunger element in fluid communication with said discharge tube, and a spray nozzle element secured in said plunger discharge channel with an orifice therethrough configured to expel fluid therethrough in a generally conical-shaped spray pattern in a direction perpendicular to said longitudinal axis;

said elongate hair styling implement rear portion has a depending semi-circular skirt defining a semi-circular cavity;

said semi-circular cavity is configured to be snap fitted onto said plunger element; and upon said pressing said hair styling implement downward, said plunger element contained in said semi-circular cavity moving with said hair styling implement and depressing said outwardly projecting discharge tube parallel to the longitudinal axis of said aerosol or pump container to open said dispensing valve.

9. The combination hair styling implement and valve actuator attachment according to claim 8 wherein said semi-circular cavity has a first lip on a bottom end extending radially inward a short distance; and said forwardly extending flat portion has a second lip depending a short distance from an underside thereof;

said first and second lips sized to snap fit and releasably engage exterior surfaces of said cylindrical plunger element.

10. The combination hair styling implement and valve actuator attachment according to claim 1 wherein said discharge tube has a generally cylindrical plunger element with a central vertical bore engaged on its outwardly projecting portion, a discharge channel extending laterally outward from an upper end of said central bore to the exterior of said plunger element in fluid communication with said discharge tube, and a spray nozzle element secured in said plunger discharge channel with an orifice therethrough configured to expel fluid therethrough in a generally conical-shaped spray pattern in a direction perpendicular to said longitudinal axis;

said elongate hair styling implement rear portion has an interior surface engaged on a top surface of said plunger element, a flexible depending portion curved downwardly about an axis transverse to said longitudinal axis and terminating in a semi-circular skirt curved about an axis parallel to said longitudinal axis;

said semi-circular skirt dimensioned to be snapped onto the exterior of said cylindrical aerosol or pump container; and upon pressing said hair styling implement rear portion downward, said rear portion interior surface flexing downwardly and depressing said outwardly projecting discharge tube parallel to the longitudinal axis of said aerosol or pump container to open said dispensing valve.

11. A combination hair styling implement and valve actuator attachment for a cylindrical aerosol dispenser container of the type having a dispensing valve in an upper end, the attachment comprising:

an elongate hair styling implement having a rear portion with a tubular discharge tube projecting outwardly from a bottom end thereof, said discharge tube having a central bore and a bottom end dimensioned to engage and depress said dispensing valve parallel to a longitudinal axis of said aerosol container to open said dispensing valve;

spray nozzle means contained in said rear portion in fluid communication with said discharge tube central bore for expelling fluid therethrough in a direction perpendicular to said longitudinal axis in a generally conical-shaped spray pattern;

a flat portion extending forwardly a distance from said rear portion at an angle relative to an axis perpendicular to said longitudinal axis and generally parallel to the outer periphery of said conical-shaped spray pattern; and said flat portion terminating in a distal end portion configured to manipulate and arrange sections of hair;

said aerosol container being held in the hand of an operator while manipulating and arranging sections of hair and said hair styling implement rear portion selectively depressed by a finger of the hand holding said container to apply an amount of the contents of said container to the hair.

12. The combination hair styling implement and valve actuator attachment according to claim 11 wherein said distal end portion comprises a plurality of parallel laterally spaced projections extending a distance from said forwardly extending flat portion and in a plane transverse to said longitudinal axis.

13. The combination hair styling implement and valve actuator attachment according to claim 11 wherein said rear portion has a top surface with a concave depressed area to receive the finger of the operator.

14. The combination hair styling implement and valve actuator attachment according to claim 13 wherein said concave depressed area has a plurality of transversely extending raised ridges to provide a textured surface to aid in preventing the finger of the operator from slipping off said top surface.

15. The combination hair styling implement and valve actuator attachment according to claim 11 wherein said rear portion has a depending generally cylindrical portion surrounding said discharge tube in radially spaced concentric relation and terminating at a bottom end a distance above said discharge tube bottom end;

a discharge channel extending laterally outward from an upper end of said discharge tube central bore to the exterior of said generally cylindrical portion in fluid communication with said discharge tube central bore; and a spray nozzle element secured in said discharge channel and having an orifice therethrough configured to expel fluid therethrough in a generally conical-shaped spray pattern in a direction perpendicular to said longitudinal axis.

16. The combination hair styling implement and valve actuator attachment according to claim 11 wherein said rear portion has a depending semi-circular skirt defining a semi-circular cavity;

a cylindrical plunger element releasably engaged in said semi-circular cavity;

said cylindrical plunger element having a bottom end and said discharge tube is integrally formed on said plunger element bottom end and extends vertically downward a distance from said plunger bottom end, a discharge channel extending laterally outward from an upper end of said discharge tube central bore to the exterior of said plunger element in fluid communication with said discharge tube central bore, and a spray nozzle element secured in said plunger discharge channel with an orifice therethrough configured to expel fluid therethrough in a generally conical-shaped spray pattern in a direction perpendicular to said longitudinal axis; and upon said pressing said hair styling implement downward, said discharge tube at said plunger element bottom end moving downward with said hair styling implement to depress and open said dispensing valve parallel to the longitudinal axis of said aerosol container to open said dispensing valve.

17. The combination hair styling implement and valve actuator attachment according to claim 16 wherein said semi-circular cavity has a first lip on a bottom end extending radially inward a short distance; and said forwardly extending flat portion has a second lip depending a short distance from an underside thereof;

said first and second lips sized to snap fit and releasably engage exterior surfaces of said cylindrical plunger element.

18. The combination hair styling implement and valve actuator attachment according to claim 11 wherein said discharge tube is integrally formed on a bottom end of a generally cylindrical plunger element and extends vertically downward a distance from said plunger bottom end, said plunger element having a discharge channel extending laterally outward from an upper end of said discharge tube central bore to the exterior of said plunger element in fluid communication with said discharge tube central bore, and a spray nozzle element secured in said plunger discharge channel with an orifice therethrough configured to expel fluid therethrough in a generally conical-shaped spray pattern in a direction perpendicular to said longitudinal axis; and said elongate hair styling implement rear portion has an interior surface engage on a top surface of said plunger element, a flexible depending portion curved downwardly about an axis transverse to said longitudinal axis and terminating in a semi-circular skirt curved about an axis parallel to said longitudinal axis;

said semi-circular skirt dimensioned to be snapped onto the exterior of said cylindrical aerosol container; and upon pressing said hair styling implement rear portion downward, said rear portion interior surface flexing downward and depressing said plunger element and said discharge tube parallel to the longitudinal axis of said container to open said dispensing valve.

* * * * *